United States Patent [19]

Fischer

[11] Patent Number: 4,577,556

[45] **Date of Patent: * Mar. 25, 1986**

[54] DAMPING FLUID APPLICATION AND METERING APPARATUS FOR A PRINTING MACHINE

[75] Inventor: Hermann Fischer, Augsburg, Fed. Rep. of Germany

[73] Assignee: M.A.N. Roland Druckmaschinen Aktiengesellschaft, Offenbach am Main, Fed. Rep. of Germany

[ * ] Notice: The portion of the term of this patent subsequent to Mar. 25, 2003 has been disclaimed.

[21] Appl. No.: 676,781

[22] Filed: Nov. 30, 1984

[30] Foreign Application Priority Data

Dec. 10, 1983 [DE] Fed. Rep. of Germany ..... 3344777

[51] Int. Cl.[4] ..... B41F 7/26; B41F 7/36; B41F 31/14

[52] U.S. Cl. ..... 101/148; 101/350; 101/DIG. 6

[58] Field of Search ..... 101/148, DIG. 6, 350, 101/349, 351, 352, 207–210

[56] References Cited

U.S. PATENT DOCUMENTS 2,622,521 12/1952 Larsen ..... 101/DIG. 6
3,094,065 6/1963 Roberts ..... 101/148
3,467,008 9/1969 Domotor ..... 101/148 X
4,119,031 10/1978 Ottenhues ..... 101/247

FOREIGN PATENT DOCUMENTS 2516863 5/1983 France ..... 101/DIG. 6

*Primary Examiner*—J. Reed Fisher
*Attorney, Agent, or Firm*—Frishauf, Holtz, Goodman & Woodward

[57] ABSTRACT

Individual disks or roller elements (4) are located, axially positioned next to each other, on a water roller transfer structure. To provide for smooth operation of rollers of a roller train of the machine, the disks or roller elements (4) of the water roller structure are in continuous surface engagement with a receiving roller, forming part of the machine roller train, and driven at machine speed. The disks or roller elements (4) are individually selectively shiftable about the circumference of the receiving roller (5) by deflection of individual angled levers (6) for selective engagement with a water supply roller (2) operating, for example, in a water trough (1), receiving water from the water supply roller. The receiving roller (5) is axially oscillating or reciprocating, and may form part of the inker of the printing machine and, further, has engagement contact with additional rollers (5', 5'') of the inker of which one (5''), for example, also is axially reciprocating or oscillating.

20 Claims, 7 Drawing Figures

FIG. 2
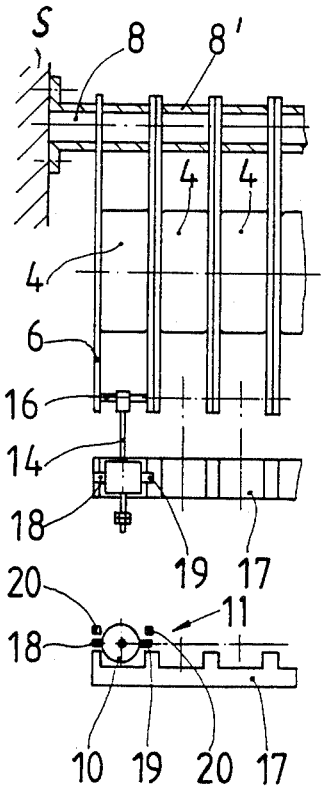
FIG. 3
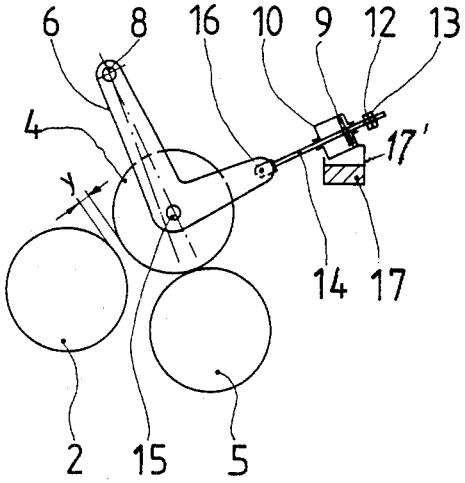
FIG. 4

DAMPING FLUID APPLICATION AND METERING APPARATUS FOR A PRINTING MACHINE

Reference to related applications, assigned to the assignee of the present invention, the disclosure of which is hereby incorporated by reference:

U.S. Ser. No. 676,783, filed Nov. 30, 1984, FISCHER; U.S. Ser. No. 676,784, filed Nov. 30, 1984, FISCHER. Related patent: German Democratic Republic Patent DD-PS No. 104 259.

The present invention relates to printing machines, and more particularly to a damping fluid application and metering apparatus, in which a damping fluid roller structure is used having a plurality of axially spaced disks or roller elements to transfer damping fluid, in axially zoned metered layers on a damping fluid transfer roller. The apparatus is particularly suitable for rotary offset printing machines.

BACKGROUND

It has previously been proposed—see German Pat. No. 883 288, to which U.S. Pat. No. 2,622,521, LARSEN, corresponds—to apply damping fluid by damping fluid metering disks which are in engagement with a damping fluid pick-up roller and which, by an axially continuous, rotatable square element, can be engaged with a subsequent damping fluid transfer roller. This arrangement does not permit individual adjustment or placement of a particular disk or roller element, selectively, in transferring engagement between the pick-up roller and the subsequent transfer roller as desired. Consequently, individual metering, in axial zones, of the quantity of damping fluid being transferred to the damping fluid transfer roller is not possible, since the individual disks or roller elements cannot be separately controlled. Further, since the individual disks, as described in this reference, are not in continuous surface contact with the transfer roller, disks do not contribute to spreading or distributing of the damping roller film on the transfer roller, and, hence, to spreading and distributing of the film on downstream roller elements forming a roller train for the damping fluid, since they are held in continuous engagement with the damping fluid pick-up roller and are moved towards the transfer roller only when damping fluid is to be transferred. The entire structure is comparatively complex since more than the customary roller elements in the damping fluid train have to be used.

THE INVENTION

It is an object to utilize the advantages of a damping fluid system which includes disk-type damping liquid rollers, or roller elements, without, however, being subjected to the disadvantages above referred to.

Damping fluid, typically, is water; and, for simplicity herein, reference will be made to "water" whenever damping fluid is to be referred to although, of course, other fluids which may be used are also to be deemed to be included in the term "water" as used herein. The term "water" is selected merely for simplicity and because of its extensive use.

Briefly, in accordance with the invention, the roller transfer structure is formed by a plurality of rotatable, axially adjacent disks or stub roller elements, movably positioned in the damper roller train, and so located therein that the disks or roller elements are in continuous surface engagement with the damping liquid (that is, typically water) receiving roller. This is the roller which is downstream—in the direction of water transfer—of the transfer roller structure with the disks or individual roller elements. Movement of the disks or roller elements is controlled to be essentially in a path about the circumference of the water-receiving roller, so that no shocks or impingement vibration are transferred thereto upon engagement of selected roller elements with a water supply roller; likewise, continuous engagement permits spreading, distributing and splitting of the water layer on the water-receiving roller. No acceleration or braking effects will be transferred to the receiving roller, since the respective disks or roller elements of the transfer structure continuously rotate at the circumferential speed of the water-receiving roller. The water-receiving roller may be axially reciprocating or oscillating.

The arrangement has the additional advantage that the water transfer structure can be readily added to conventional already constructed dampers, without substantial change or modification of the overall roller arrangement, or its placement in the overall damper structure.

In accordance with a feature of the invention, the disks or roller elements are individually movably supported for selectively establishing a continuous serial linear transfer path of water through the water roller train, from a water supply, such as a water trough, and a water pick-up roller; or, selectively, interrupting said path from the water supply, the water-receiving roller being driven to operate at machine speed. The spaced disks or roller elements, themselves, are so located that they are in continuous surface engagement with the water-receiving roller but, selectively, in engagement with the water supply roller to pick up, from the supply roller, the respectively required water in specific printing zones which is to be supplied by the selected disks or roller elements.

DRAWINGS

FIG. 2 is a fragmentary side view showing pneumatic control for respective ink disks;

FIG. 3 is a schematic side view illustrating the operation of the pneumatic control;

FIG. 4 is a fragmentary schematic view illustrating the bearing arrangement for a plurality of pneumatic control units;

DETAILED DESCRIPTION

Figure 1:
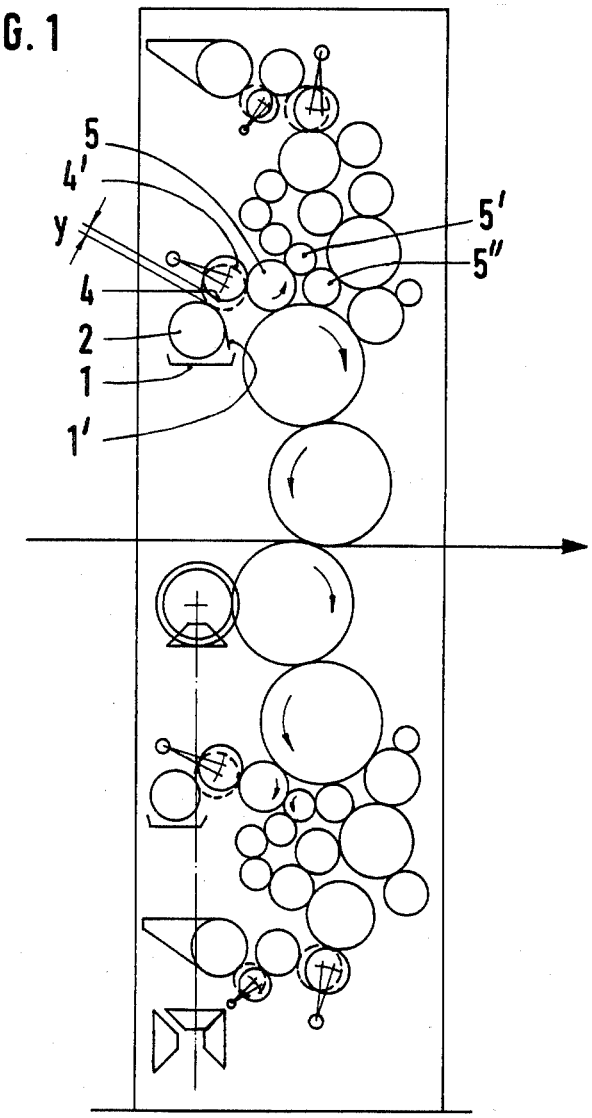
FIG. 1 is a schematic side view of a printing machine having a water roller train which, generally, can be conventional, modified, however, by the structure in accordance with the present invention.

FIG. 1 illustrates, highly schematically, a printing station of a perfecting-type rotary offset printing machine; only those elements necessary for an understanding of the present invention have been given reference numerals, since all other elements are entirely conventional.

A water trough 1 has a water pick-up roller 2 located therein. The surface speed of the water pick-up roller 2 can be identical to that of the surface speed of the remaining water transferring rollers as well as the printing rollers and the printing machine, that is, the circumferential speed of roller 2 can be the same as that of the plate cylinder or blanket cylinder, shown in conventional arrangement in FIG. 1. Since the pick-up roller 2 will operate, thus, at quite high speed, splashing of water from the trough 1 can be eliminated by a splash shield 1'. Such splash shield may be in the form of sheet metal shields, plastic plates or flaps, or the like.

In accordance with a feature of the invention, the water supply is transferred to a water supply transfer or application roller 5 in axially controlled zones by water metering disks or roller elements 4. The transfer roller 5 may, directly, apply the water to the plate cylinder and/or may be in additional contact with rollers 5' and 5'' of the inker. At least one of the rollers 5', 5'', preferably, is axially oscillating; likewise, the roller 5 which transfers water may be axially oscillating. If desired, additional intermediate rollers between the rollers 5, 5', 5'' and the plate cylinder may be provided, or additional rollers within the respective inkers and dampers may be used. The inker is shown only schematically and may be constructed for example as described in the referenced applications by the inventor hereof, U.S. Ser. No. 676,784, filed Nov. 30, 1984, and/or U.S. Ser. No. 676,783, filed Nov. 30, 1984.

In accordance with a feature of the invention, the transfer roller 5, which is also part of the inker roller train, is axially oscillating. The damper, then, can be constructed very compactly, while still providing for sufficient distribution, splitting and spreading of the water film. As best seen in FIG. 1, the individual disks or roller elements 4 remain in continuous surface engagement with the roller 5, thus continuously contributing to spreading and distribution of the water film on the roller 5. The movement of the position of the rollers 4 is shown, schematically, in FIG. 1, in which the changed position of the rollers 4, when picking up water from the pick-up roller 2, is shown in broken lines, and has been given the designation 4'. Since, as noted, the roller 5 preferably is in engagement with a further roller 5', and roller 5' in engagement with the roller 5'', in which roller 5'' is also axially oscillating, the water film is additionally supplied to the plate cylinder and is distributed both by the roller 5' and the second roller 5''.

The metering disk or roller elements 4 are selectively applied by a mechanism shown in greater detail in FIGS. 2–4. As best seen in FIGS. 2 and 3, the elements 4 are located in axial alignment, adjacent each other, but separated from each other by spacing bushings 8', thereby defining the axial zone positions of the disks or roller elements 4. Each roller element or disk 4 is held in position by at least one—preferably two—angled pivot levers 6. Preferably, one pivot lever 6 is located at each end face of an element 4. One end of the pivot lever 6 is pivotably secured on a shaft 8, on which the bushings 8' are located. Shaft 8 is secured to a side wall S of the printing machine. The levers 6 are angled levers—see FIG. 3—and the opposite end thereof is pivotably linked, at 16, to a control apparatus, preferably a cylinder-piston arrangement which may be operated pneumatically, hydraulically, or may be replaced by an electromagnetic structure. In the example selected, the control arrangement is a pneumatically operated piston-cylinder combination, having a piston 9 operable within a cylinder 10. The piston 9 is movable to cover the path or distance y, and is pivotably secured in a bearing 11 (FIG. 4). The stroke of the piston 9 can be adjusted by setting nuts 12, 13 which, for example, can be engaged against the cylinder 10, respectively, or against a fixed abutment 17' of the machine.

The engagement force of the respective disks or roller elements 4 in the direction of the roller 2 will be determined by the air pressure within the cylinder 10. The disks or roller elements 4 are located centrally on the lever 6, rotatable about a pin 15. The piston rod 14 is pivotably connected by a bolt 16 with an end of the lever 6. To engage the respective disks or roller elements 4 in the direction of the ink-receiving roller 5, the levers 6 are preferably located on a shaft 8 by means of eccentric elements.

In accordance with a feature of the invention, continuous contact is maintained between the metering disks or roller elements 4 and the receiving roller 5. This contact is maintained even if the circumference of one of the engaging elements, that is, the disks or elements 4 or the roller 5, respectively, becomes worn.

Figure 5:
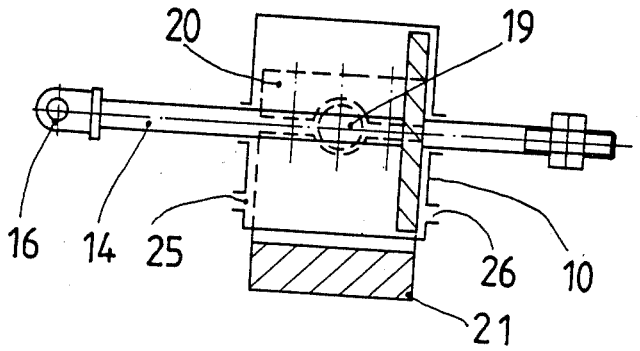
FIG. 5 is a schematic detail view of a bearing arrangement for a pneumatic control element.

The cylinder 10 is preferably retained to be pivotable within a bearing 11, in order to carry out the movement of the respective disks or roller elements 4 about or around the circumference of the receiving roller 5, in the direction of the supply roller 2 over the path distance y. The cylinder 10, as best seen in FIGS. 4 and 5, has lateral stub shafts 18, 19 secured thereto which, preferably, are journalled in a common comb strip 17. These stubs 18, 19, which form bearing pins, are retained in position and closed off by a bearing cover 20. A common support base 21 is provided to receive the bearing pins 18, 19.

The system is controlled by a control unit 23 which controls the required water in respective axial zones to be transferred to the receiving roller and hence through the roller train to the plate cylinder. The control unit is shown connected only to one cylinder; a plurality of outputs 23' from the control unit will be provided, however, one to each one of the control units 9, 10 for the respective disks or roller elements 4. The control unit may be arranged to provide water supply, in accordance with preset, manual requirements, as determined by the subject matter to be printed, or can be automatically controlled based on water requirements, as communicated to the control unit by a sensing structure, well known in the prior art, and determining the respective water requirement in axial zones, to be transferred to the plate cylinder.

Figure 6:
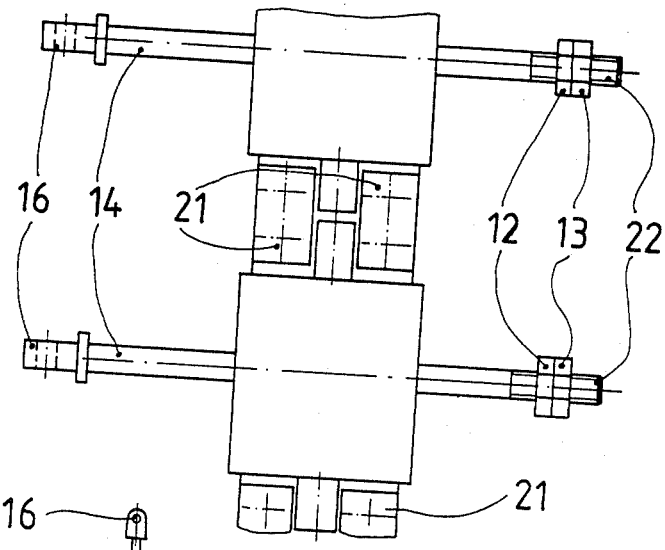
FIG. 6 is a schematic detail view of a bearing arrangement for a plurality of pneumatic control elements.
Figure 7:
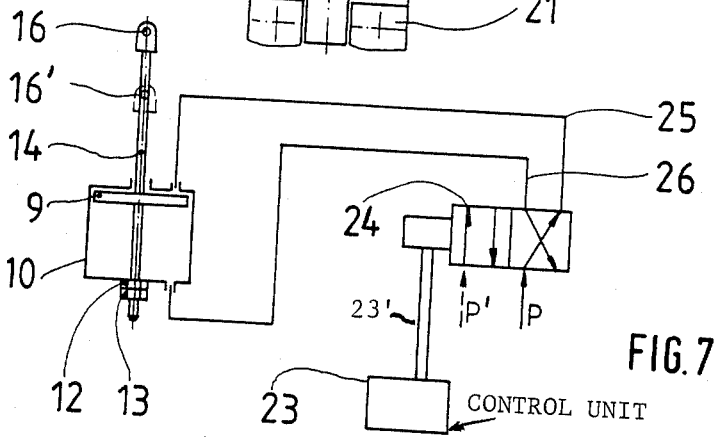
FIG. 7 is a valving and control diagram for pneumatic control of respective disks of the transfer roller structure.

The control unit 23 has the output 23' connected for a specific piston-cylinder combination in form of an electrical signal applied to a magnetic control valve 24 which receives, for example, compressed air shown schematically by the arrows P, P'. The magnetic control valve 24, selectively, applies compressed air to the output lines 25, 26, in accordance with the output from the control unit, to thereby control movement of the piston 9 within the cylinder 10. For example, if compressed air P' is supplied over line 26, piston rod 14 is projected and the bolt and link 16 will assume the position shown in FIG. 7 in full lines. Upon application of compressed air to line 25, as shown by the arrow P, the piston 9 will be moved downwardly—with respect to FIG. 7—and the piston rod 14 will be retracted, moving the pivot bolt 16 to the broken-line position shown at 16'. The movement is transferred over the lever 6 to the respective disk or roller element 4 which will roll about the circumference of the receiving roller 5 to, selectively, contact the roller 2, or leave the space y therefrom. The two positions of the roller elements or disks 4 are shown in FIG. 1, in, respectively, full-line and broken-line position. It should be noted that in both positions, the roller elements 4 are in contact with the receiving roller 5. The adjustment nuts 12, 13 are threaded on an end portion of the piston rod 14, as best seen in FIG. 6, for appropriate adjustment against, for example, the abutment 17'.

Various changes and modifications may be made within the scope of the inventive concept.

I claim:

1. Damping fluid application and metering apparatus for an offset printing machine, particularly rotary offset printing machine, having a plate cylinder being driven at a predetermined circumferential machine speed;

a damping fluid supply roller (2) carrying a film of damping fluid;

a damping fluid-receiving foller (5);

a damping fluid transfer roller structure having a plurality of rotatable axially spaced roller elements (4); and comprising, means (6) for rotatably supporting said spaced roller elements for selectively establishing a controlled continuous serial linear damping fluid transfer path from the damping fluid supply roller (2) to the receiving roller (5) or, selectively, interrupting said continuous transfer path, wherein, the receiving roller (5) is an axially reciprocating roller and is driven to operate at machine speed;

the support means (6) individually support the individual roller elements (4) in continuous surface engagement with the axially reciprocating receiving roller (5);

means for mounting said support means for individual movement of selected roller elements about an axis located on the opposite side of said roller elements from said fluid-receiving roller, said mounting means including means to maintain engagement of said fluid-receiving roller and said roller elements as said support means is moved about said axis for controlled proximity of said roller elements with the supply roller (2) and consequent transfer of damping fluid from the supply roller (2) to the receiving roller (5) as selectively controlled, in axially spaced zones, in accordance with individual selective engagement or disengagement of said roller elements (4) with the supply roller (2)

and individual stop means (12, 13, 17') are provided, coupled to the support means for adjustably controlling the extent of movement of the support means (6) and hence the degree of proximity of the respective roller element (4) with the damping fluid supplied roller.

2. Apparatus according to claim 1, wherein the receiving roller (5) is part of an inker roller train for the printing machine;

a first milling and distributing roller (5') is in surface contact engagement with the receiving roller (5); p1 and a second milling and distributing roller (5'') is in surface contact engagement with the first milling and distributing roller, said second milling and distributing roller being axially oscillating or reciprocating to provide for milling and distribution of ink being transferred to the inker and damping fluid being applied by the receiving roller (5), as transmitted by the disks or roller elements (4) from the damping fluid supply roller (2).

3. Apparatus according to claim 1, wherein said movable means comprises at least one angled lever (6) associated with each roller element and having one end pivoted about a fixed shaft (8);

and an operating element (9, 10, 14) coupled to the other end of each said angled lever.

4. Apparatus according to claim 3, including a pair of bearing pins (18, 19) for each operating element, pivotably retaining the respective operating element in position in the printing machine;

the respective operating elements being pivotably secured to the respective angled lever at approximately the apex of the angle, pivotable movement of the operating element permitting at least approximately circular displacement of the respective roller element (4) along the circumference of the receiving roller (5).

5. Apparatus according to claim 3, wherein a pair of angled levers (6) are provided for each operating element, the respective roller element (4) being located between the angled levers of the pair;

and wherein an individual operating element (9, 10, 14) is operatively connected to each pair of the angled levers (6).

6. Apparatus according to claim 4, including a common support strip (17) retaining the bearing pins of the respective operating elements in position in the machine.

7. Apparatus according to claim 3, wherein the operating elements comprise a cylinder-piston units.

8. Apparatus according to claim 7, wherein the cylinder-piston units comprise a pneumatic cylinder-piston units;

and a magnetic control valve means (24) is provided, controlling the pneumatic cylinder-piston units.

9. Apparatus according to claim 3, wherein individual control elements (24) are provided for controlling the respective operating elements.

10. Apparatus according to claim 9, wherein the operating elements are pneumatic cylinder-piston units;

and the individual control means comprise magnetic control valves (24).

11. Apparatus according to claim 3, wherein the angled levers are eccentrically rotatable about the shaft (8).

12. Apparatus according to claim 1, wherein the roller elements (4) of the transfer roller structure are driven by surface-frictional engagement with the receiving roller (5).

13. Apparatus according to claim 2, wherein the receiving roller (5) and the second distributing and spreading roller (5'') are in surface engagement with the plate cylinder.

14. Apparatus according to claim 2, wherein the roller elements (4) of the transfer roller structure are driven by surface-frictional engagement with the receiving roller (5).

15. Apparatus according to claim 2, wherein said movable support means comprises an angled lever (6) having one end pivoted about a fixed shaft (8);

and an operating element (9, 10, 14) coupled to the other end of the angled lever.

16. Apparatus according to claim 15, wherein at least one angled lever (6) is provided for each roller element (4);

and wherein an individual operating element (9, 10, 14) is operatively connected to each one of the angled levers (6).

17. Apparatus according to claim 16, wherein the operating element comprises a fluid-operated cylinder-piston unit;

and a magnetic control valve (24) is provided, controlling fluid supply and drainage, respectively, to said cylinder-piston unit.

18. Apparatus according to claim 1, wherein the support means includes a coupling rod (14) and the stop means includes adjustment nuts (12, 13) threaded on the coupling rod and engageable against a fixed stop (10, 17').

19. Apparatus according to claim 7, wherein each cylinder-piston unit includes a piston rod (14);

and the stop means includes adjustment nuts (12, 13) threaded on the piston rod and engageable against a fixed stop (10, 17').

20. Apparatus according to claim 17 wherein individual control elements (24) are provided for controlling the respective operating elements;

each cylinder-piston unit includes a piston rod (14);

and the stop means includes adjustment nuts (12, 13) threaded on the piston rod and engageable against a fixed stop (10, 17').

* * * * *